United States Patent [19]

Aitkenhead et al.

[11] Patent Number: 5,067,144

[45] Date of Patent: Nov. 19, 1991

[54] EQUALIZED RADIOGRAPHY USING SPECIAL MODULATOR PINS

[75] Inventors: William F. Aitkenhead, Sharon; Russell J. Gershman, Middleborough, both of Mass.

[73] Assignee: Hologic, Inc., Waltham, Mass.

[21] Appl. No.: 525,498

[22] Filed: May 18, 1990

[51] Int. Cl.[5] ..... G21K 5/10

[52] U.S. Cl. ..... 378/146; 378/145

[58] Field of Search ..... 378/146

[56] References Cited

U.S. PATENT DOCUMENTS

| | | | |
|---|---|---|---|
| 4,675,893 | 6/1987 | Duinker et al. | 378/151 |
| 4,677,652 | 6/1987 | Duinker et al. | 378/151 |
| 4,715,056 | 12/1987 | Vlasbloem et al. | 378/146 |
| 4,741,012 | 4/1988 | Duinker et al. | 378/145 |
| 4,773,087 | 9/1988 | Plewes | 378/146 |
| 4,785,471 | 11/1988 | Boersma | 378/146 |
| 4,803,714 | 2/1989 | Vlasbloem | 378/62 |
| 4,890,312 | 12/1989 | Duinker | 378/146 |
| 4,953,189 | 8/1990 | Wang | 378/108 |

OTHER PUBLICATIONS

Vlasbloem et al., Radiology, vol. 169, pp. 29–34 (Oct. 1988).

Plewes, D. B. and Vogelstein, E., Exposure Artifacts in Raster Scanned Equalization Radiography, Med. Phys., vol. 11, pp. 158–165 (1984).

*Primary Examiner*—Craig E. Church

*Attorney, Agent, or Firm*—Cooper & Dunham

[57] ABSTRACT

An equalization radiography system using specially shaped and arranged modulator pins which reduce artifacts by effectively smoothing variations in attenuation as between adjacent pins.

20 Claims, 13 Drawing Sheets

EQUALIZED RADIOGRAPHY USING SPECIAL MODULATOR PINS

BACKGROUND OF THE INVENTION

The invention relates to radiography and particularly to equalized radiography which improves diagnostic capabilities by selectively subjecting denser parts of the examined object to higher intensity radiation to render them more fully exposed and image them with greater contrast and detail. In such radiography, a fan of penetrating radiation sweeps the object while being locally modulated to vary the radiation intensity both as between different sectors of the fan and in the scanning direction in order to selectively equalize the radiation delivered to the image plane.

In conventional radiography, image quality and diagnostic value can be compromised when the object density differs too much as between different parts of the object. For example, in conventional chest x-rays the mediastinum and retrocardiac area could be underexposed, detracting from the diagnostic value of the image. Equalization radiography, which is capable of varying the local x-ray exposure to areas in the image to compensate for the local patient attenuation, particularly in the case of chest x-rays, can improve image quality and diagnostic value.

Typical examples of such feedback-controlled equalization radiography are discussed in the commonly assigned Wang European Patent Application No. 86308224.4 (based on a U.S. application leading to U.S. Pat. No. 4,953,189; see, in particular, FIG. 8 showing wedge-shaped attenuator elements) as well as in Plewes U.S. Pat. No. 4,773,087 and U.S. Pat. application Ser. No. 07/242,644 filed Sep. 13, 1988 (see, in particular, FIGS. 3 and 5 showing overlapping shutter pins in two rows). Further examples are discussed in U.S. Pat. Nos. 4,675,893, 4,715,056, 4,677,652, and 4,741,012. All of the prior documents cited in this paragraph are hereby incorporated by reference in this specification. Further background material concerning the subject can be found in the documents made of record in said Plewes application.

In a typical prior art example, an x-ray fan beam scans the patient and a modulator unit locally controls the x-rays before they reach the patient in order to modulate the radiation differently as between different sectors of the fan and as between different stages of the scanning movement. The degree and kind of local modulation are under the control of a feedback circuit which locally measures the x-rays in the fan exiting the object. The goal of this local, time varying modulation is to equalize the image, i.e., to reduce the difference in exposure as between different areas of the image. The modulator unit can use a row of modulators or shutters which are individually and selectively movable into the fan to modulate it locally, e.g., by varying the local attenuation, the local beam cross-section, and/or the local exposure time of the x-rays impinging on the object being examined.

While such prior art systems could provide significant improvement, they also could introduce certain types of image artifacts. One type is in the direction of scan and could appear as streaks in the image. The inventors believe that this type of an artifact could be caused by ineffective smoothing between adjacent elements of the modulator unit, especially when at any one time during the scan the settings or positions of these adjacent elements are very different, and that artifacts could also be caused by limitations in parameters such as the sizes of the focal spot, the attenuator elements and the collimator slit at the modulator and the geometry of the modulation arrangement. Such artifacts are also noted in Vlasbloem, et al., RADIOLOGY, Vol. 169, pages 29–34 (Oct. 1988). See, also, Plewes, D.B. and Vogelstein, E., Exposure Artifacts in Raster Scanned Equalization Radiography, Med. Phys. Vol. 11. pp. 158–165 (1984). Other artifacts could be in the direction normal to the scan direction and others could be in other directions or positions. Of course, it is desirable to minimize any deleterious effects of such artifacts on the diagnostic value of the image.

SUMMARY OF THE INVENTION

One object of the invention is to improve equalization radiography by reducing image artifacts. Another is to use a modulator which provides smoother variations in modulation from one fan beam sector to another. Yet another is to smooth the overlap area between adjacent modulator elements, especially when the settings or positions of adjacent modulator elements differ significantly. Still another is to derive benefits from factors which may have been considered limitations in the prior art, such as the finite size of the focal spot.

In an exemplary embodiment of the invention, an x-ray source/modulator assembly generates a fan beam which is thin in the horizontal direction and tall in the vertical direction. The assembly sweeps the beam horizontally across the object being examined while selectively and individually modulating sectors of the beam, by special modulator elements described below, to vary the intensity of the radiation delivered to the object by the respective beam sectors. A detector/film assembly receives the fan exiting the object and, as the fan sweeps across the object, one part of this assembly measures the x-ray intensity distribution to generate feedback information while another part forms an x-ray image of the object. The feedback information, along with information related to the effect that the modulator has on individual detector elements, is used to estimate the effect of the object being examined and to control the modulator so as to increase or decrease the local amount of radiation delivered to the object.

In a single scan mode, the information required to adjust the modulator is generated and used substantially in real time, to the extent permitted by inherent circuit delays. In a dual scan mode, the first scan is at reduced x-ray intensity and can be either equalized or non-equalized. The x-ray intensity can be reduced to a level that would not cause any significant exposure on the film, e.g., by controlling the x-ray tube filament current. The detected intensity levels coupled with the modulator element attenuation positions can be used to determine desired exposure settings and to calculate an equalization function used to perform "real-time" equalization during the second scan. If in a single scan mode the modulator is locked to a fixed position, the result would be similar to a conventional x-ray image.

In order to reduce artifacts due to the modulation, special modulator elements are used. In a preferred but non-limiting example of the invention, they are in the form of modulator pins which slide back and forth in the horizontal direction into the fan of x-rays. This fan is defined by a vertically extending pre-patient collimator slit aperture. An object field collimator provides adjustments for film orientation and also for at least the lower edge of the object exposure field. The size of the slit aperture is adjustable horizontally to set the fan dimension in the horizontal plane (e.g., from about 0" to 0.5" at the slit aperture plane, which translates to about 0" to 3.5" at the image plane).

In a non-limiting example, 35 modulator pins are used, made of an attenuating material such as aluminum and arranged in two rows which are along respective arcs that are centered at the focal spot and are in a vertical plane that includes the focal spot. The parts of the modulator pins that slide into the fan are in the shape of wedges which have generally triangular sections in a vertical plane. The bases of the triangular sections are along the arcs which are centered at the focal spot. The bases of the pins within a row are as close to each other as practical considerations would allow and, as viewed from the focal spot when all pins are fully into the fan, adjacent pins from different rows overlap so much that any ray from the focal spot is more likely than not to be intercepted by two pins, one from each row. The attenuation of the fan beam due to any one modulator pin is a function of how far into the fan the pin extends. For any one vertical plane in the fan, the attenuation due to a given modulator pin is a function of the area of the generally triangular section of the pin which is in that vertical plane.

Stated more broadly, the modulator comprises portions of a radiation attenuating material which are adjacent each other along the larger angular extent of the fan of radiation and individually and selectively slide into the fan to: (1) vary the radiation along the larger angular extent of the fan smoothly while individually and selectively modulating the sectors of the scanning fan to reduce or eliminate objectionable artifacts at the image plane; and (2) make uniform to a selected degree the exposure which the fan exiting the object delivers to the image plane.

While in the currently preferred example the attenuating portions are in the form of individual modulator pins, which could have rounded or truncated wedge ridges and tips, in an alternative embodiment the modulator uses a flexible diaphragm of a material such as leaded rubber of which portions are pushed into the fan by pins which also are arranged in one or more vertically extending rows and slide individually and selectively horizontally in or toward the plane of the fan. Further, while in the currently preferred embodiment which is described in detail below the fan sweeps the object generally horizontally, other scanning directions are possible. For example, in another preferred embodiment, the larger angular extent of the fan is generally horizontal and the fan sweeps the object in the vertical direction, in which case the modulator pins (which scan together with the fan) slide generally vertically into the plane of the fan. The detailed description below is for a fan scanning in the horizontal direction, but it should be understood that the invention is applicable to a vertically scanning fan as well and the same description applies with an appropriate change in the directional terms.

DETAILED DESCRIPTION

Figure 1:
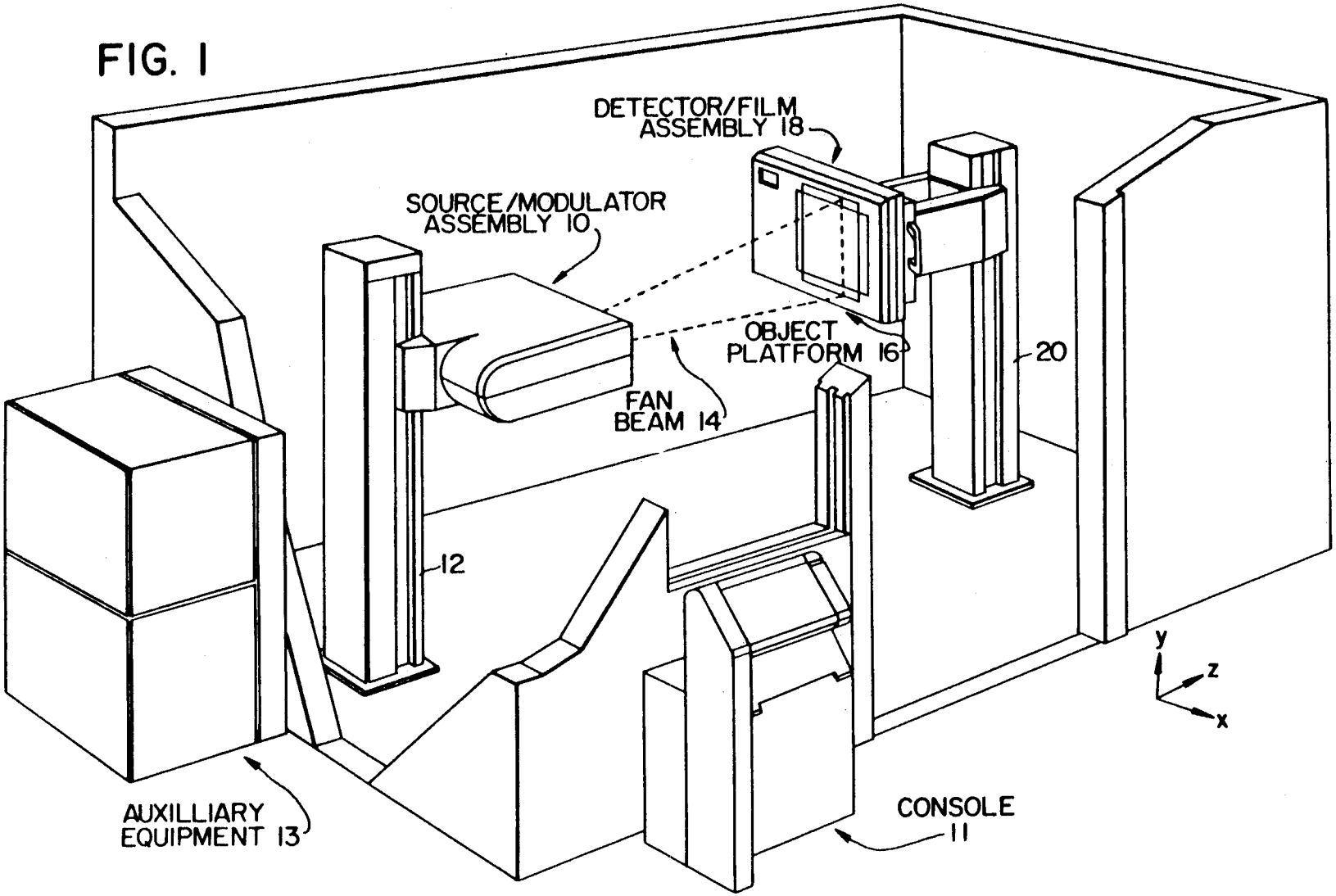
FIG. 1 is a perspective view of an equalized radiography system using the invention.
Figure 2:
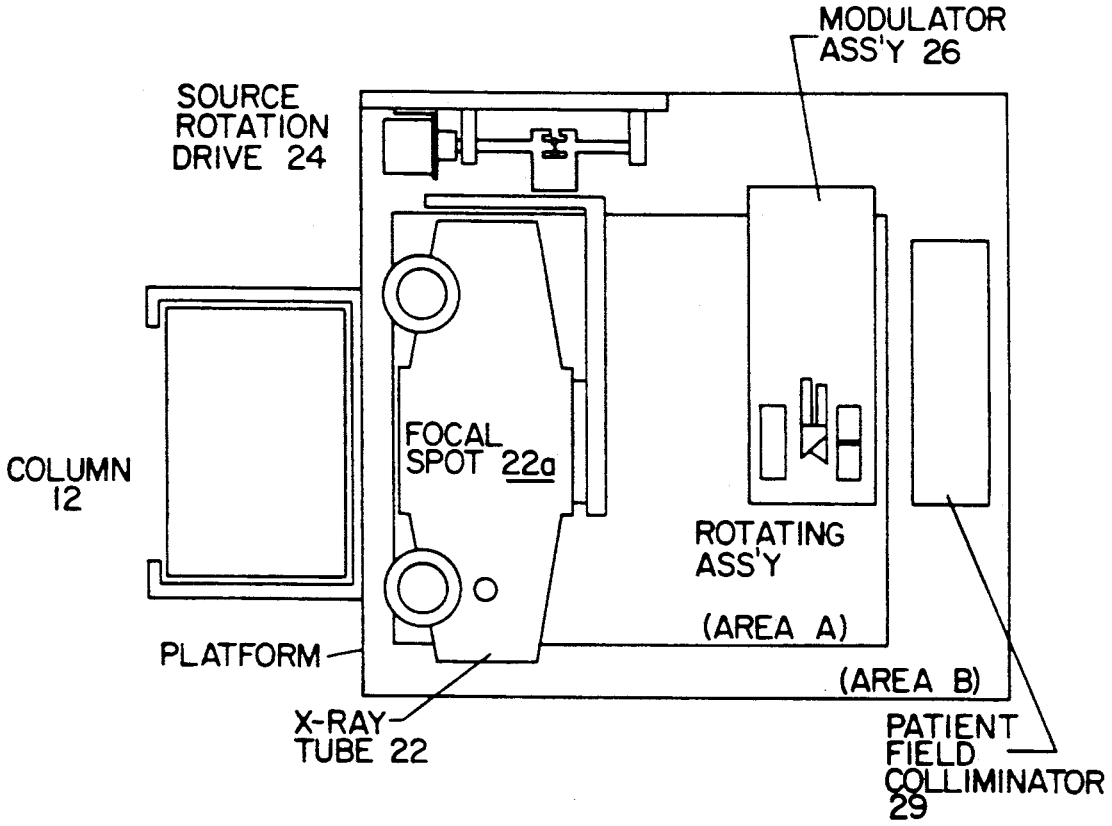
FIG. 2 shows a horizontal section of a supporting column and of the source/modulator assembly.

In a preferred but non-limiting example of the invention, an x-ray source/modulator assembly 10 slides up and down along column 12 so that it can be positioned at a selected vertical (y-direction) level prior to the x-ray procedure. When energized, assembly 10 generates a fan beam 14 which is thin in the horizontal (x) direction and tall in the vertical direction, and sweeps beam 14 horizontally across an object position 16 while selectively and individually modulating vertically spaced sectors of beam 14 to vary the intensity of the radiation delivered to object position 16 (or to an object 16 at that position) by the respective beam sectors. Also prior to the x-ray procedure, a detector/film assembly 18 slides vertically along column 20, preferably in synchronism with assembly 10, to a vertical position at which assembly 18 can receive an object-attenuated fan beam 14' exiting object 16. As fan beam 14 sweeps horizontally across object 16, assembly 18 receives the post-object radiation and uses it for two purposes: (i) to measure the radiation intensity distribution of fan beam 14' and in response to generate feedback information; and (ii) to image object 16. The feedback information, along with information related to the effect that the modulation has on individual sectors of fan 14, is used to estimate the attenuating effect of object 16 and to control the modulator to increase or decrease the local amount of radiation delivered to object 16 in order to selectively equalize the radiation delivered to assembly 18.

As best seen in FIGS. 2 and 3*a*–3*c*, source/modulator assembly 10 comprises an x-ray tube 22 having a focal spot 22*a*. In order to sweep object 16 with fan 14 horizontally, source rotation drive 24 selectively pivots tube 22 horizontally, with focal spot 22*a* serving as the center of rotation. Affixed to tube 22 to pivot therewith is a modulator assembly 26. In order to shape the radiation from tube 22 into the desired fan beam, assembly 26 has a fixed collimator 28 defining the maximum vertical extent of fan 14, a patient field collimator 29 which can be adjusted to define the size of the irradiated, typically rectangular area at the image plane, and an adjustable collimator 30 defining a vertically extending collimator slit that determines the horizontal dimension of fan 14. For a given sweep of fan 14, the setting of patient field collimator 29 typically is fixed so that the fan at the film plane would irradiate only the field of the desired size and shape, e.g., for standard x-ray film sizes and orientations. The slit aperture of collimator 30 can be set depending on factors such as the overall size and expected attenuation properties of the object, etc. to deliver the desired overall intensity to the object. For example, the slit aperture could be set to a horizontal dimension in the range of 0" to 0.5" at the aperture plane, which corresponds to about 0" to 3.5" at the image plane.

Figure 3A:
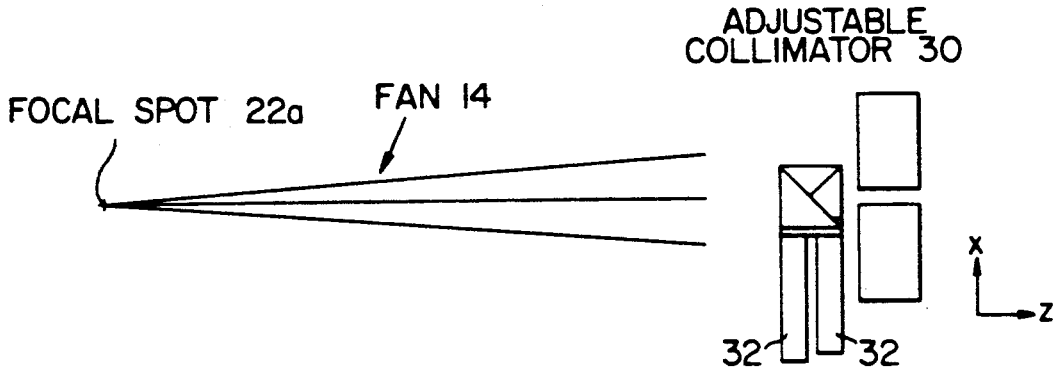
FIG. 3*a* is a top view and FIG. 3*b* is a side view of a portion of the modulator assembly, showing modulator pins and a pre-patient collimator.
Figure 3B:
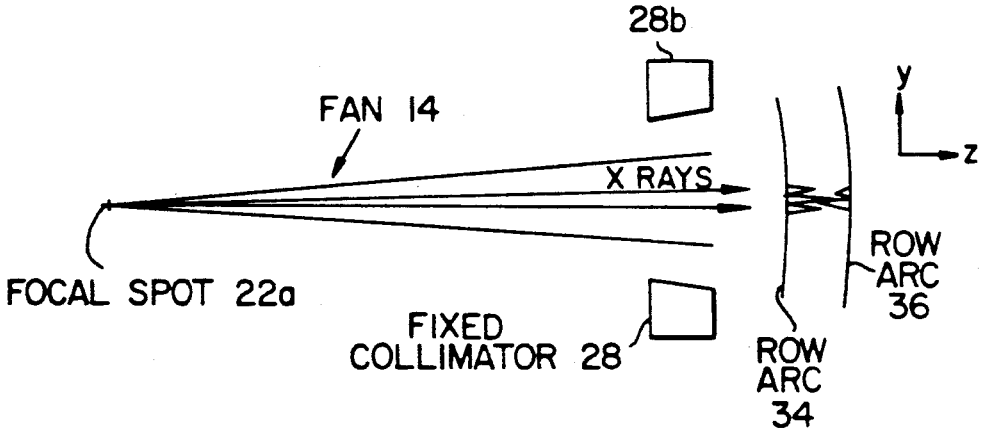
Figure 3C:
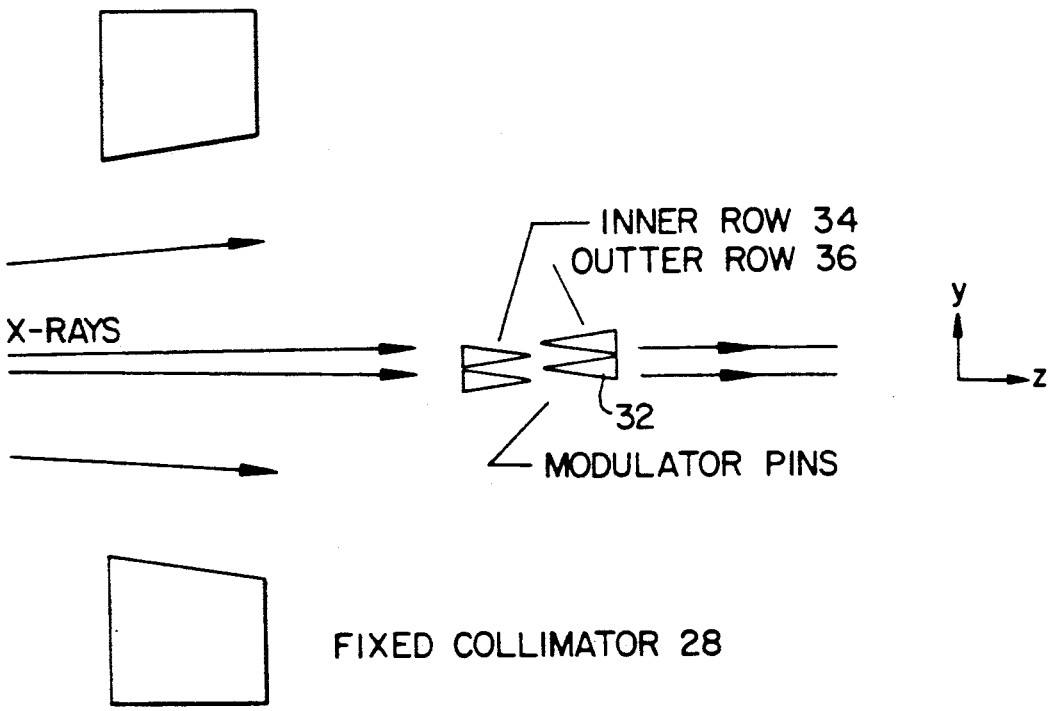
FIG. 3*c* is a detail of FIG. 3*b*.

In order to individually and selectively modulate vertically spaced sectors of fan 14, modulator assembly 26 uses modulator pins 32 which are arranged in two generally vertical rows, inner row 34 and outer row 36 (FIG. 3*b*), along respective arcs which are centered at focal spot 22*a* of tube 22 and are in a vertical plane that includes focal spot 22*a*. Pins 32 slide individually and selectively into fan beam 14 in the horizontal, x-direction (along the plane of the paper in FIG. 3*a* and normal to the paper in FIGS. 3*b* and 3*c*) such that the pin section in a vertical plane within fan 14 is generally triangular, as illustrated in FIGS. 3*b* and 3*c*. This triangular area and the attenuation of a respective beam sector increase as a pin moves further into fan 14.

Figure 4A:
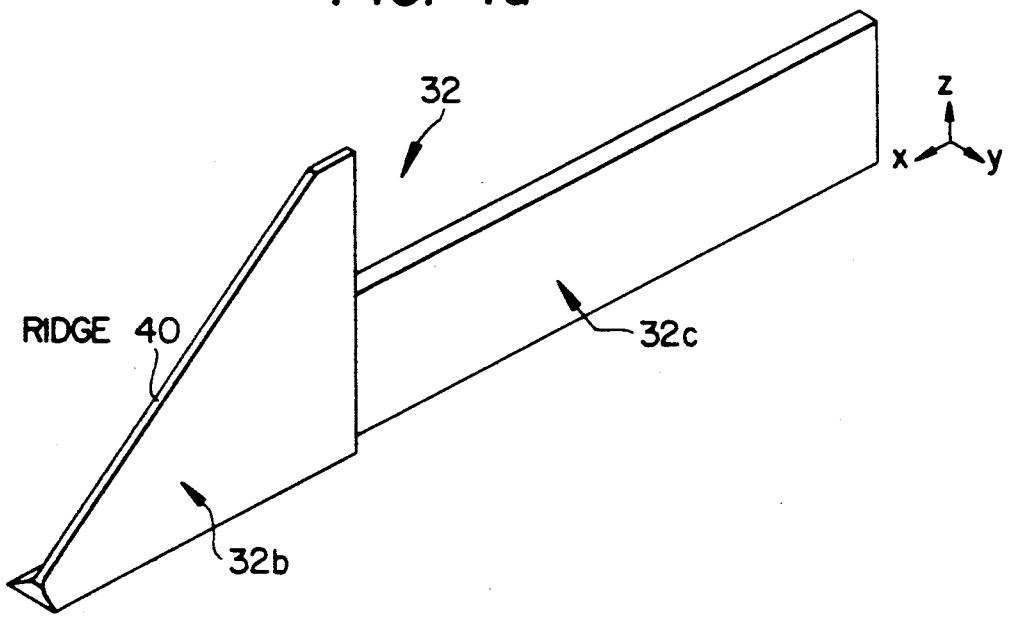
FIG. 4*a* and FIG. 4*b* are two perspective views showing a modulator pin substantially to scale.
Figure 4B:
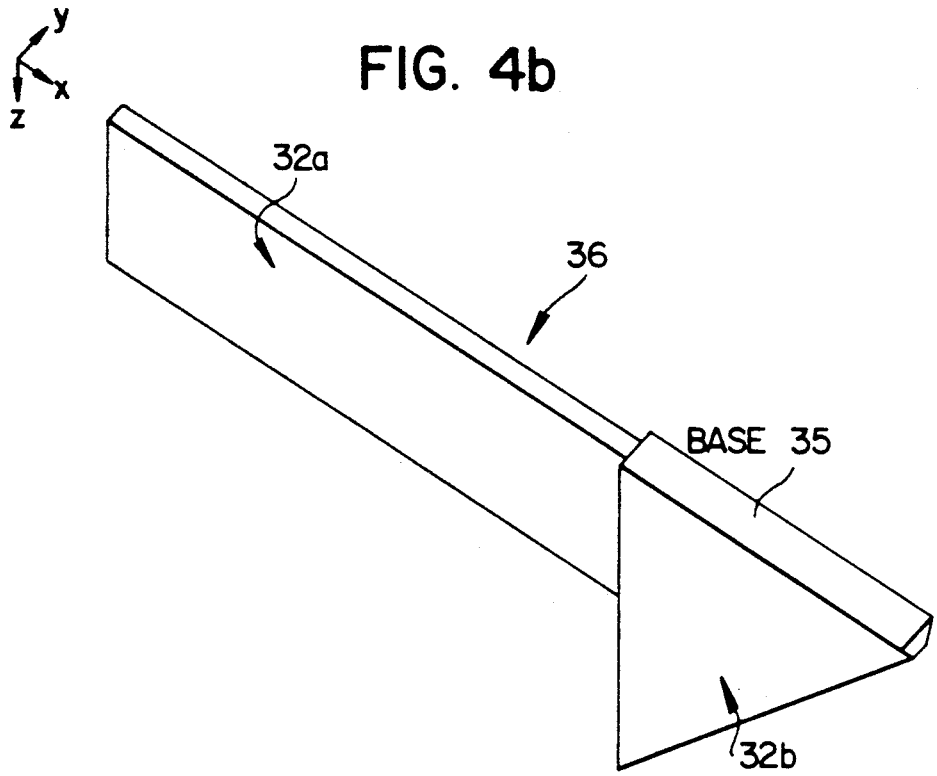
Figure 4C:
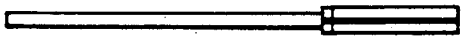
FIGS. 4*c*–4*g* are, respectively, right side, top, front, back and left side views of a modulator pin
Figure 4F:
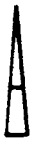
Figure 4D:
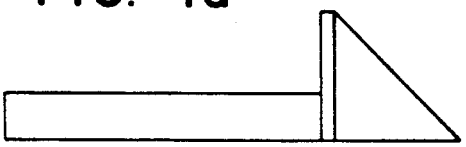
Figure 4E:
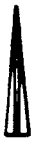
Figure 4G:
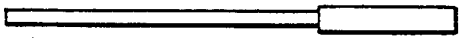
Figure 4H:
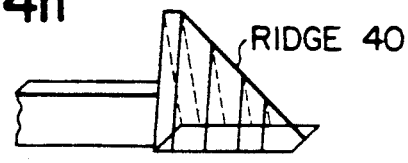
FIG. 4*h* is a detail of a perspective view.

As best seen in FIGS. 4*a*–4*h*, a modulator pin 32 comprises an elongated stem 32*a* and a wedge-shaped head 32*b*. Base 38 of head 32*b* is rectangular. Ridge 40 slopes from the back (the stem) toward the front of the pin such that the area of the triangular section gradually decreases toward the tip of the wedge-shaped head. Stated differently, the z-direction dimension of the triangular section (i.e., the dimension along the direction of propagation of the appropriate ray in fan 14) decreases gradually in moving toward the tip of the pin. Ridge 40 can be rounded or truncated, as illustrated in FIG. 4*a*, and the tip of the pin can be truncated as also seen in FIG. 4*a*. In fact, FIGS. 4*a* and 4*b* illustrate pin 32 close to scale. In an alternative embodiment, the ridge can be truncated to a significantly greater extent, to arrive at the shape illustrated in FIGS. 9*a*–9*d*.

Bases 38 of the pins in row 34 are as close to each other as allowed by factors such as mounting and sliding movement constraints, and the same is true of the pins in row 36. The pins of the two rows are offset such that the center line of ridge 40 of a pin in row 36 is along a ray of fan 14 passing through the small distance between two adjacent pins 32 of row 34. Accordingly, if all pins 32 are all the way into fan 14, most rays of fan 14 would pass through both a pin of row 34 and a pin of row 36. The exception would be the relatively few rays that would pass through the small distance between two adjacent pins in row 34 or two adjacent pins of row 36. Since any one pin 32 can slide into fan 14 independently of the other pins of either row, a given ray within fan 14 can pass through no pin, through one pin, or through two pins.

Figure 5A:
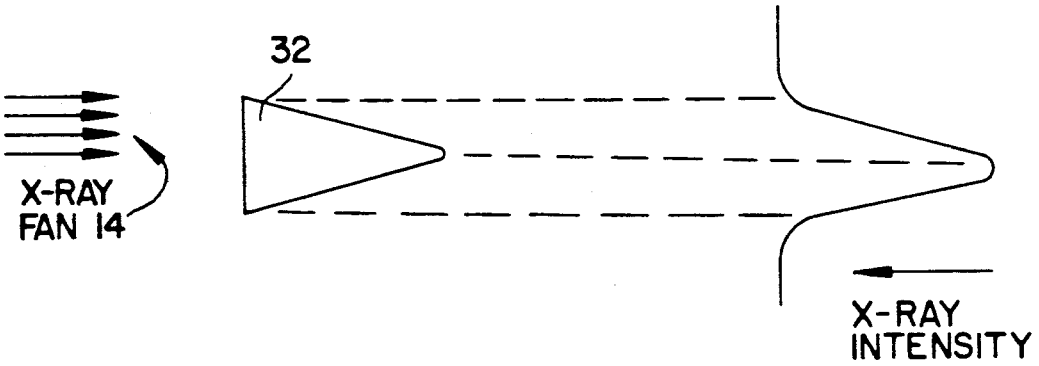
FIG. 5*a* illustrates a section of a single modulator pin in a vertical plane in the fan beam and the intensity profile in that plane of radiation modulated by that section.
Figure 5B:
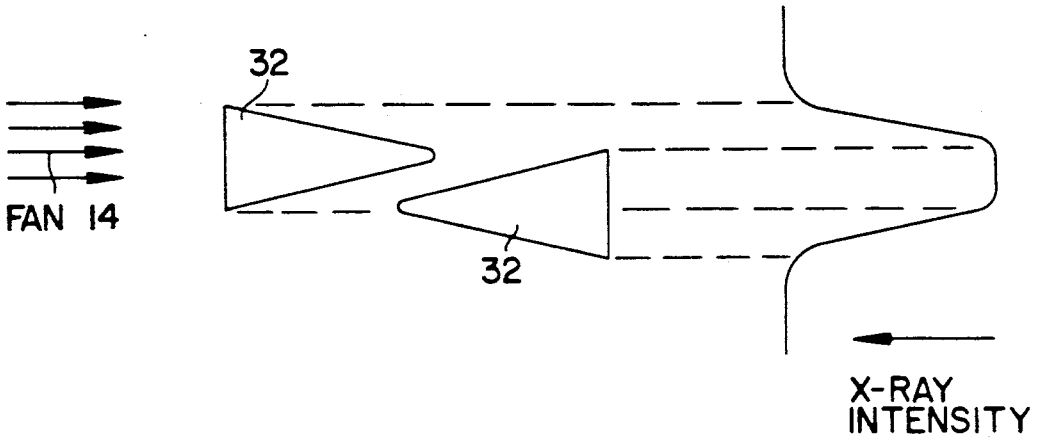
FIG. 5*b* illustrates the case for equal area sections of two modulator pins.
Figure 5C:
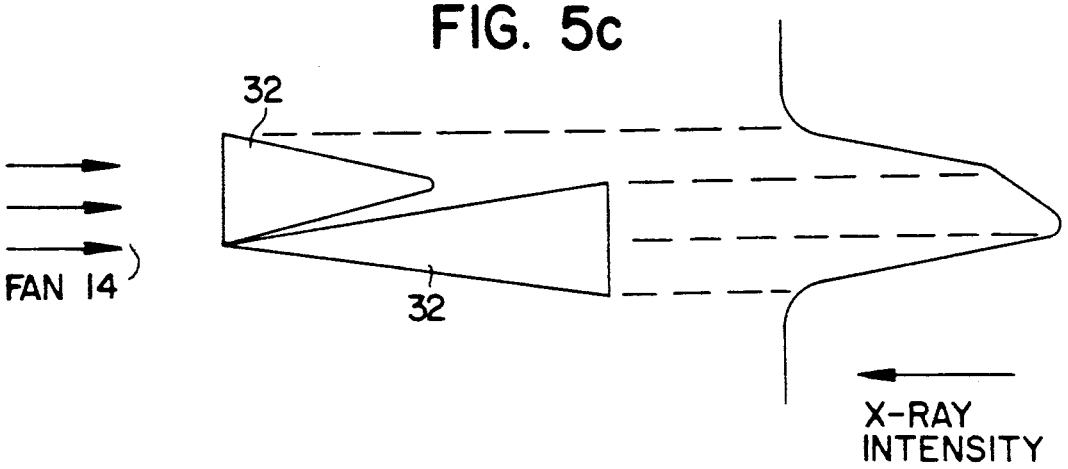
FIG. 5*c* illustrates the case for unequal area sections of two pins.

In order to reduce artifacts while taking into account reasonably expected relative positions of pins 32, factors such as the relative dimensions, shapes and placement of focal spot 22*a* and pins 32 are carefully selected to achieve a smooth intensity profile in the vertical direction within fan 14. For example, when a vertical plane of fan 14 passes through a section of a pin 32 as illustrated at FIG. 5*a*, the intensity profile I of that plane as affected by that section varies smoothly as illustrated. Similarly, when two approximately equal pin sections 32 are in a fan plane as illustrated in FIG. 5*b*, the intensity profile in that plane as affected by those two sections varies smoothly as illustrated. Still similarly, when two unequal area sections of pins 32 are in a plane of the fan as illustrated in FIG. 5*c*, the intensity profile still varies smoothly as illustrated.

In a currently preferred embodiment, modulator pins 32 vary the intensity of respective sectors of fan 14 in ratio of about 5:1 between most and least attenuation. A ray can pass through a minimum of less than 0.125" of pin material to a maximum of about 1"; at 140 KV source voltage this corresponds to a transmitted radiation ratio of about 1:5. The geometry is such that the maximum intensity change can occur within about 0.5" at the film plane in the vertical direction. In order to achieve a smooth intensity profile by taking into account typical focal spot sizes, pins 32 are placed about 7 to 15 inches from the focal spot and the base 35 of a pin in a plane normal to the scan direction is about 2 to 5 times the size of the focal spot, e.g., if the focal spot diameter is about 1 mm (e.g., 1.2 mm), the base is about 3 mm (e.g., 3.2 mm). A typical distance between the focal spot and the image plane is about 72 inches. A typical time for a scan is 1 sec.

While the pins in rows 34 and 36 are shown in a preferred configuration in which the ridge (i.e., the apex of the triangular section) of each pin of one row faces the apices of the triangular sections of the pins of the other row, other configurations are possible. Any ridge can point toward or away from the focal spot which is the origin of the fan beam. For example, the apices of all pins, of both rows, can face in the same general direction such that the apices of one row face the bases of the other row, or the apices of the two rows can point to opposite directions such that the bases of one row face the bases of the other row, and in each case both rows of modulator pins can be at one side of the collimator 30 (at the source side, as shown, or at the opposite side), or collimator 30 can be between the two rows on modulator pins. In addition, while as shown the tips of the modulator pins all point in the same direction (the x-direction), the pins can be mounted such that the tips of the two rows face each other such that the pins of one row slide into fan 14 from the left but the pins of the other row slide into the fan from the right.

Figure 6A:
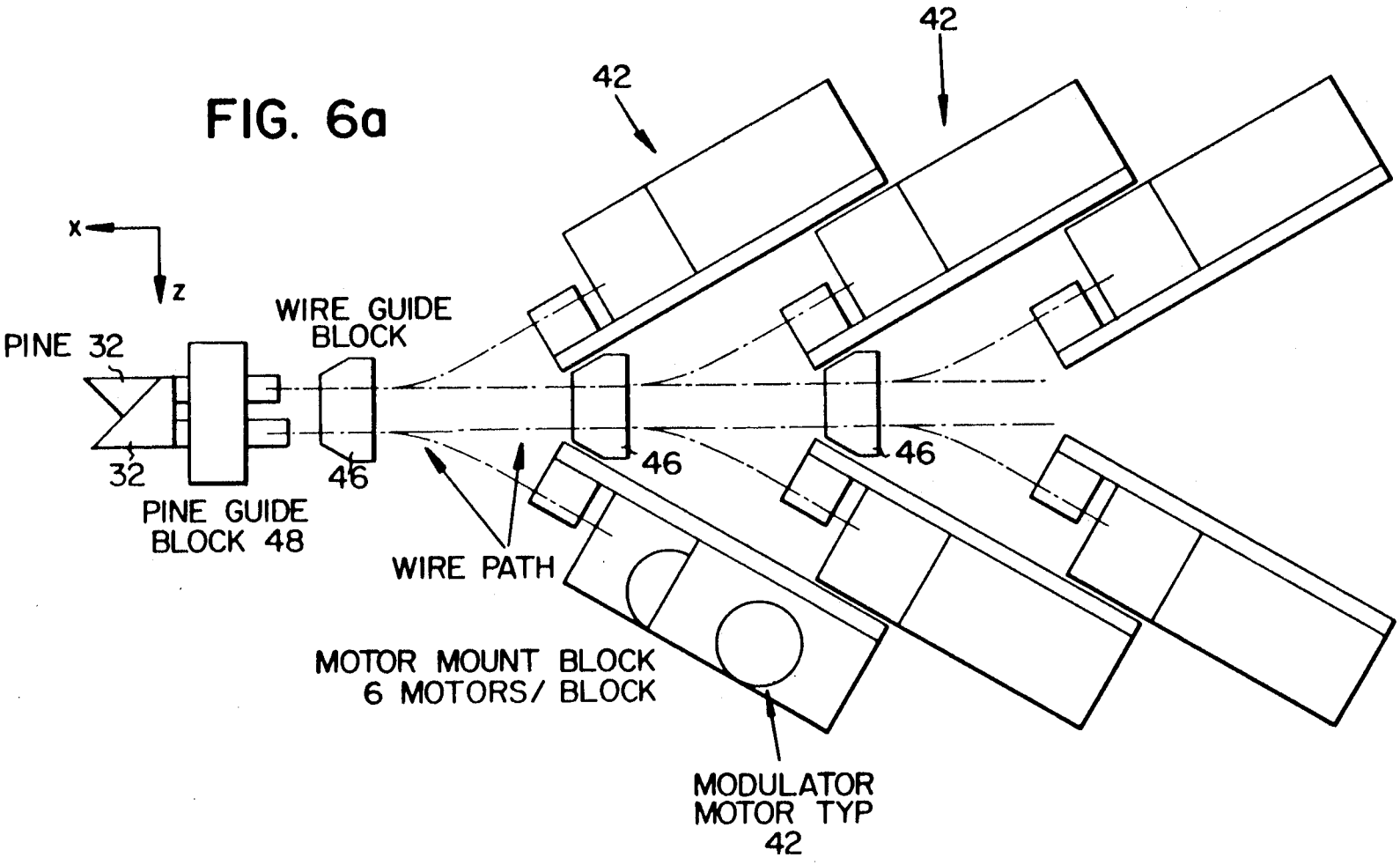
FIG. 6*a* is a top view of a part of the modulator assembly illustrating the means for sliding the modulator pins and FIG. 6*b* is a detail.
Figure 6B:
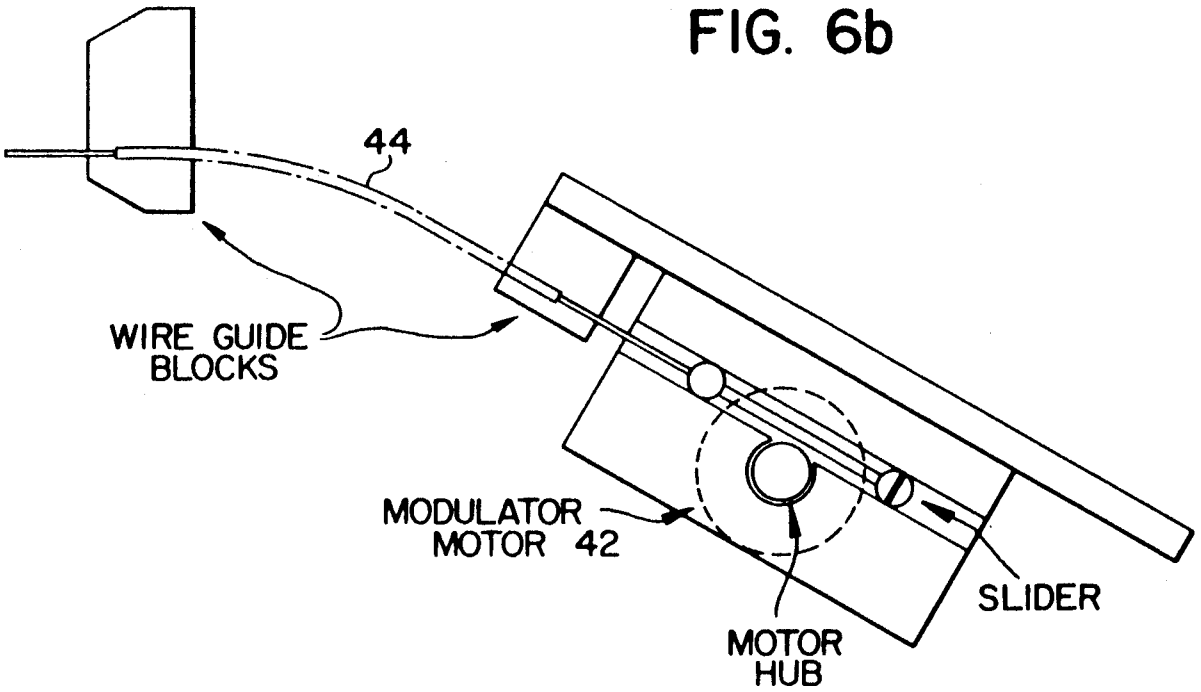

As seen best in FIGS. 6*a* and 6*b*, pins 32 are driven by respective modulator motors 42 to slide selectively into fan 14. Each motor 42 can be a stepper motor connected to the respective pin 32 through a flexible linkage 44 passing through one or more wire guide blocks 46. Pins 32 are slidably mounted in a pin guide block 48 in which each pin stem slides in the x-direction in a respective slot that helps maintain a precise sliding path for the pin. In the preferred but non-limiting example, the stroke of a modulator pin can be about 1", performed by about 40 contiguous steps of a motor 42, each resulting in a change of about 4% in transmitted intensity of a respective sector of fan 14.

Figure 7:
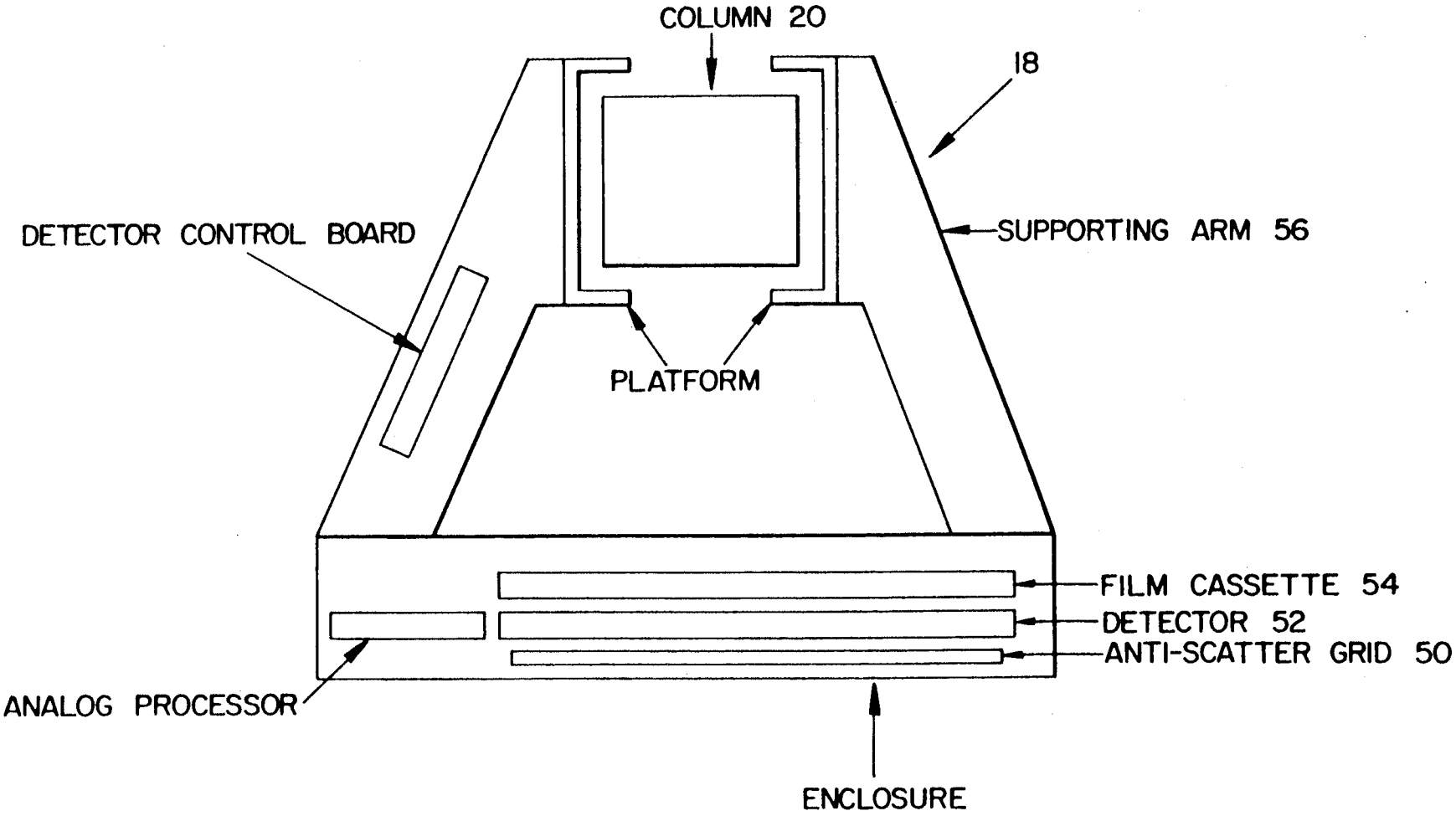
FIG. 7 is a top, partly sectional view of the detector/film assembly.

As best seen in FIG. 7, beam 14' exiting the object impinges on detector/film assembly 18 which comprises the following elements arranged in the propagation, z-direction of the x-rays: an anti-scatter grid 50, a feedback detector 52, and a film cassette 54. These elements are mounted in a supporting arm 56 slidably mounted on column 20. Grid 50 can comprise a 12:1 scatter rejection grid for reducing the amount of scattered radiation reaching detector 52. Detector 52 can comprise a flat plate Xenon detector having an active volume of, e.g., 17×17×0.25" and filled with Xenon at about 1 atmosphere pressure. The electrodes on one side can be horizontally extending strips 0.23" high and 17" long, separated vertically by insulating spaces of 0.02". Preferably it attenuates fan beam 14' as little as possible, e.g., about 12% attenuation Film cassette 54 can be a standard 14×17" cassette mountable in either orientation.

Figures 8A, 8B, 8C:
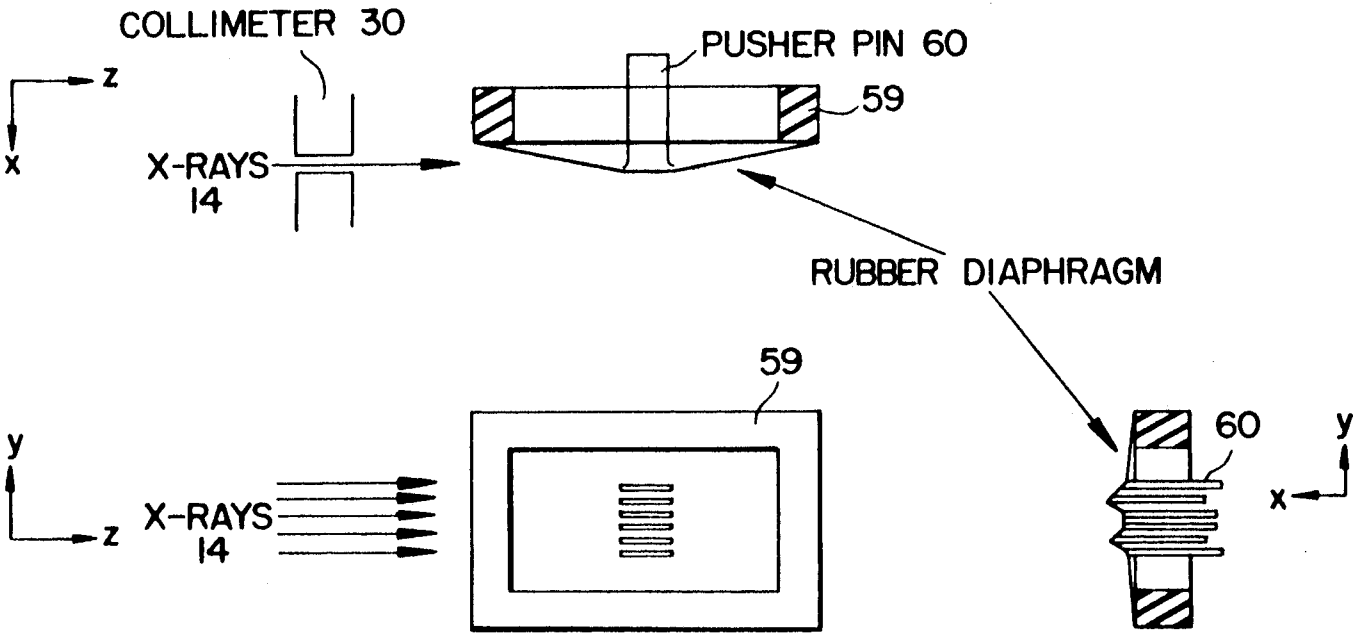
FIG. 8*a* is a top view.
FIG. 8*b* is a side view.
FIG. 8*c* is a view as seen from the focal spot, illustrating an alternate embodiment using a leaded rubber diaphragm to modulate the fan beam.
Figure 9A:
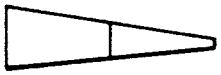
FIGS. 9*a*–9*d* are, respectively, a front, right, top and partial back views of an alternate modulator pin.
Figure 9B:
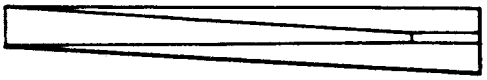
Figure 9D:
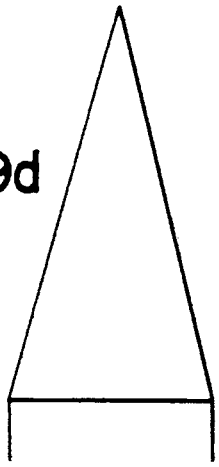
Figure 9C:
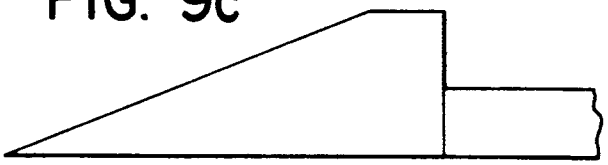

In an alternative embodiment, modulator pins 32 can be replaced with the structure illustrated in FIGS. 8*a*–8*c* which comprises a flexible diaphragm 58 of an attenuating material such as leaded rubber, mounted on a frame 59, and pusher pins 60. Pusher pins 60 slide toward or into fan 14 similarly to modulator pins 32. However, while they may provide some selected attenuation, their main purpose is to push a selected portion of diaphragm 58 into fan 14 to a selected degree. Because of the way diaphragm 58 stretches, the intensity along the vertical direction of fan 14 varies smoothly. While as illustrated pusher pins 60 push the diaphragm from only one side, it is possible to have pusher pins on both sides of the diaphragm, pushing from both directions to ensure that the diaphragm can be made to curve as sharply as desired.

Figure 10:
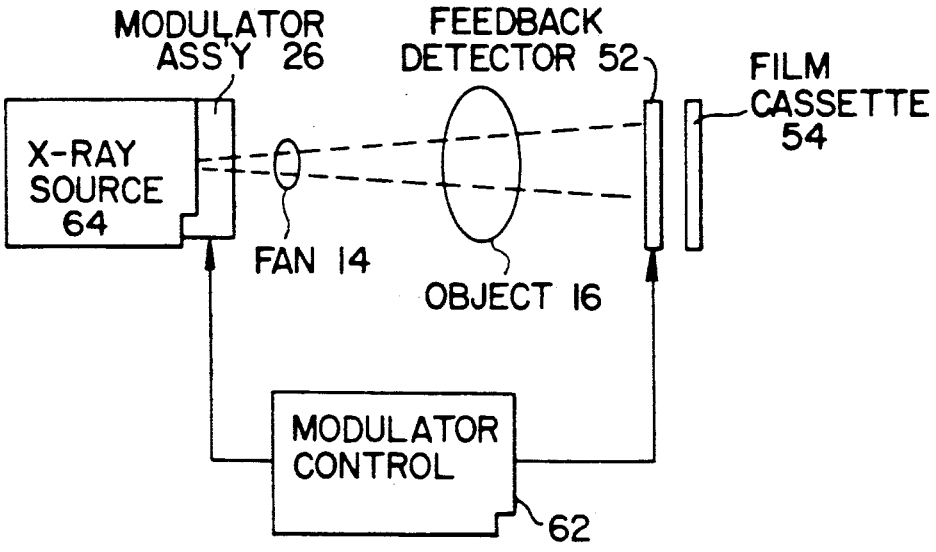
FIG. 10 is a block diagram of main components of a radiography system employing the invention.

In operation, the operator places a film cassette in detector/film assembly 18 and positions the patient (or an object) at position 16 between assemblies 10 and 18, and moves assemblies 10 and 18 up or down along the respective columns 12 and 20 to match the position of the patient or object. The operator uses appropriate data entry devices at console 11 (FIG. 1) to select the exposure setting, the voltage setting and the scan mode, and the system takes the exposure during which fan beam 14 scans object 16, feedback detector 52 generates a modulation feedback signal delivered to a modulator feedback circuit 62 (FIG. 10) which in turn feeds the desired control signals to modulator assembly 26 to control the position of pins 32 or 60 in order to equalize the exposure at a film in cassette 54. Power to the x-ray tube comes from auxiliary equipment 13 (FIG. 1).

Other types of penetrating radiation can be used in place of x-rays such as, without limitation, gamma rays or other radiation. As earlier noted, in an alternate equalized radiography system using the invention, a fan of penetrating radiation can scan generally vertically, and the detailed description set forth above applies equally well, except for interchanging the terms horizontal and vertical as appropriate.

We claim:

1. A system for examining an object with penetrating radiation, comprising:

a source/modulator which generates a fan of penetrating radiation scanning an object position and comprises wedge-shaped pins of a radiation attenuating material movable into the fan in the scanning direction and arranged in at least one row extending in a direction transverse to both the scanning direction and the propagation direction of said radiation;

each of said pins having a ridge pointing to or away from the origin of the fan and each pin having sections of different areas in different planes normal to the scanning direction; and a control circuit moving said pins individually to respective degrees into the scanning fan.

2. A system as in claim 1 in which said pins are in at least two rows spaced from each other in the propagation direction of the fan and are shaped and positioned to cause most rays in the fan to pass through a pin from each row when the pins are all the way into the fan.

3. A system as in claim 2 in which said rows of pins extend along respective arcs centered at the origin of the fan.

4. A system as in claim 3 in which said ridge is rounded.

5. A system as in claim 3 in which said ridge is truncated.

6. A system as in claim 2 in which said sections are generally triangular, each having an apex at said ridge and a base opposite the apex.

7. A system as in claim 6 in which the base does not vary in size as between different sections and as between pins.

8. A system as in claim 1 in which said sections are generally triangular, having bases which are the same in size in all sections and are spaced from each other by a distance much smaller than the size of a base.

9. A system as in claim 8 in which the pins are in at least two rows spaced from each other in the propagation direction of the fan.

10. A system as in claim 9 including a detector/imager which receives the fan exiting said object position and utilizes the received radiation to form a radiographic image of the object position and any object thereat and to generate a signal controlling said control circuit.

11. A system as in claim 1 in which the pins are in two rows spaced along the propagation direction of the fan and wherein when the pins are all the way into the fan a fan ray which passes between two adjacent pins in one row passes through the ridge of a pin in the other row.

12. A system as in claim 11 in which when all the pins are all the way into the fan, the path length of fan rays through the pins in any one of a plurality of planes normal to the scan direction does not vary substantially with angle in the fan.

13. A system as in claim 1 in which the source/modulator comprises an x-ray tube generating said radiation, the distance between the focal spot of the tube and the pins is in the range of about 7 to 15 inches and the largest dimension of a pin in a plane normal to the scanning direction is in the range of about two to four times the size of the focal spot.

14. A system as in claim 13 in which the size of the focal spot is about 1 mm and said largest dimension of a pin is about 3 mm.

15. A system for examining an object with penetrating radiation comprising:

a source/modulator which generates penetrating radiation scanning an object position and comprises attenuating portions which are individually movable into the scanning radiation along respective axes;

each attenuating portion having sections in planes transverse to the scanning direction whose areas change substantially monotonically with distance along the scanning direction over substantially the entire part of the attenuation portion that is movable into the scanning radiation to intercept the radiation, each section having a dimension in a direction transverse to both the scanning direction and the propagation direction of the radiation which changes monotonically along said propagation direction; and a control circuit which moves said attenuating portions to respective degrees into the penetrating radiation scanning the object position.

16. A system as in claim 15 in which said sections are generally triangular.

17. A system as in claim 15 in which said portions comprise pins a radiation-attenuating material which individually move into the penetrating radiation scanning the object positon.

18. A system as in claim 15 in which said sections are trapezoidal.

19. A system as in claim 15 in which said portions comprise portions of a diaphragm of a radiationattenuating material and pins which individually move in the scanning direction.

20. A method comprising the steps of:

scanning an object position with a fan of penetrating radiation and moving, together with the scanning fan, attenuating elements which are arranged in at least one row extending in a direction transverse both to the scanning direction and to the propagation direction of the fan and are individually movable into the fan in the scanning direction;

each attenuating element when moved into the fan having a ridge which faces toward or away from the origin of the fan and having different areas in sections defined by different planes which are parallel to each other but transverse to the scanning direction; and controlling the respective degrees of movement of the attenuating elements into the fan as a function of the spatial distribution of attenuating material at the object position.

* * * * *